United States Patent [19]

Kühn

[11] Patent Number: 4,509,618

[45] Date of Patent: Apr. 9, 1985

[54] OIL LUBRICATION SYSTEM, ESPECIALLY FOR KNITTING MACHINES

[75] Inventor: Falk Kühn, Rottenburg, Fed. Rep. of Germany

[73] Assignee: Erich Roser, Salem-Grasbeuren, Fed. Rep. of Germany

[21] Appl. No.: 353,891

[22] Filed: Mar. 2, 1982

Related U.S. Application Data

[63] Continuation-in-part of Ser. No. 180,988, Aug. 25, 1980, Pat. No. 4,349,085.

[30] Foreign Application Priority Data

Mar. 3, 1981 [DE] Fed. Rep. of Germany ..... 3108836

[51] Int. Cl.[3] ..... F01M 1/22; G08B 21/00

[52] U.S. Cl. ..... 184/6.4; 139/1 R; 184/6.14; 184/6.15; 184/6.28; 184/103 A; 340/679; 417/417

[58] Field of Search ..... 184/1 C, 6, 6.1, 6.4, 184/6.14, 6.15, 6.28, 7 R, 7 D, 7 E, 7 F, 26, 27 R, 27 A, 27 C, 67, 103 R, 103 A, 7 CR; 340/623, 679, 680, 681, 682; 417/415, 417; 139/1 R, 45; 66/8; 112/256

[56] References Cited

U.S. PATENT DOCUMENTS

| | | | |
|---|---|---|---|
| 1,595,292 | 8/1926 | Davis | 417/415 |
| 1,763,961 | 6/1930 | Gits | 184/67 |
| 2,403,058 | 7/1946 | Davis | 417/417 X |
| 3,078,960 | 2/1963 | Minton | 184/7 CR |
| 3,118,383 | 1/1964 | Woodward | 417/417 X |
| 3,184,725 | 5/1965 | Siegel et al. | 340/679 X |
| 3,196,389 | 7/1965 | Heidner | 340/682 X |
| 3,610,782 | 10/1971 | McGuire | 417/415 X |
| 3,620,650 | 11/1971 | Shaw | 417/417 |
| 3,656,140 | 4/1972 | Gruber et al. | 184/6.4 X |
| 3,701,139 | 10/1972 | Creuz | 340/679 X |
| 3,890,478 | 6/1975 | Riddel | 340/623 X |
| 4,191,954 | 3/1980 | Faris et al. | 340/679 |
| 4,205,708 | 6/1980 | Burgbacher | 184/6.26 X |
| 4,274,509 | 6/1981 | Thomson et al. | 184/15 B |
| 4,305,285 | 12/1981 | Kubota et al. | 340/623 X |
| 4,339,749 | 7/1982 | Yamada | 340/679 |
| 4,349,085 | 9/1982 | Roser | 184/6.15 |

*Primary Examiner*—David H. Brown
*Assistant Examiner*—John E. Griffiths
*Attorney, Agent, or Firm*—Amster, Rothstein & Engelberg

[57] ABSTRACT

An oil lubrication system, especially for knitting machines includes a plurality of electromagnetically driven piston pumps, one of which is assigned to each individual lubrication site operated by and exciting current pulses of adjustable pulse-recurrence frequency. Each piston pump has a scanning device which produces a receipt pulse during the working stroke when the pump piston reaches its end position. The current pulse and receipt pulse are applied to a monitoring device which provides an output signal if the receipt pulse is not applied within a certain time after the current pulse. An indicator light flashes at each current pulse and switches to a permanent signal when an output signal is produced. An oil storage vessel feeding the pumps can be provided with a filling state monitor when produces an electrical oil deficiency signal when the oil level falls below a predetermined minimum. Both the oil deficiency signal and the output signal are applied to a disconnecting unit which stops the machine.

3 Claims, 1 Drawing Figure

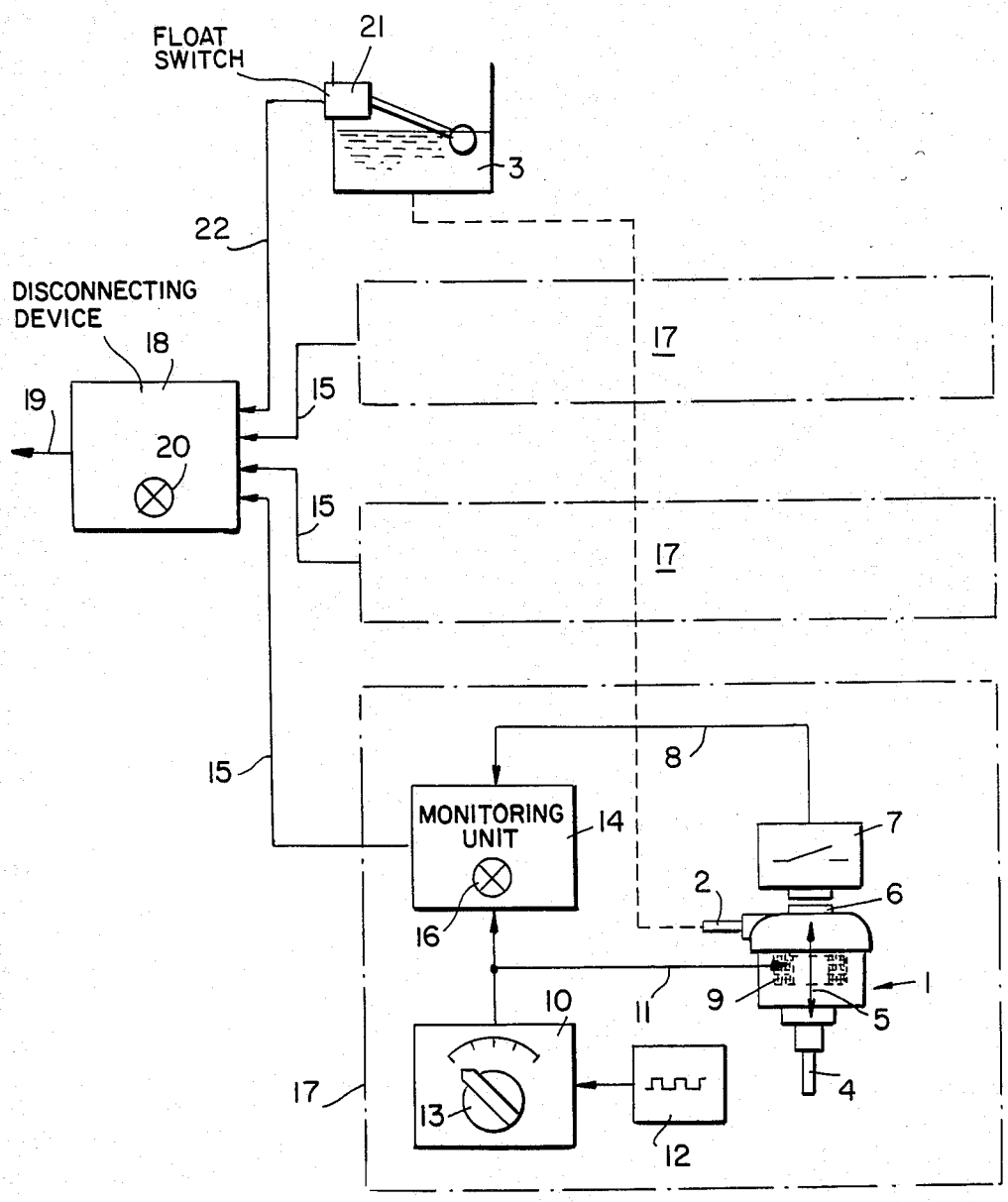
FLOAT SWITCH
21
3
22
DISCONNECTING DEVICE
18
19
20
15
15
17
17
15
8
MONITORING UNIT
14
16
7
2
6
1
9
5
10
11
4
17
13
12

OIL LUBRICATION SYSTEM, ESPECIALLY FOR KNITTING MACHINES

CROSS REFERENCE TO RELATED APPLICATIONS

Continuation-in-part of U.S. Ser. No. 180,988, 8-25-80, now U.S. Pat. No. 4,349,085.

BACKGROUND OF THE INVENTION

1. Field of the Invention

The invention relates to an oil lubrication system, especially for knitting machines, with a pulsating electromagnetically activated piston pump and a switch arrangement for the production of current impulses of adjustable pulse-recurrence frequency, whereby a piston pump and an electronic switch arrangement for its drive control are assigned to each lubrication site, and each piston pump has a pot magnet with disk-shaped armature.

2. Description of the Prior Art

The oil lubrication system described in the generic concept is the object of older patent application U.S. Pat. No. 4,349,085, which provides a directed lubricating under high pressure and thereby offers a considerable safety against impermissible changes in oil quantity or a complete clogging of the nozzles. However, functional disturbances are not completely excluded, possibly originating from mechanical or electrical causes. For example, a return spring of the electromagnetically driven piston pump can break, the driving power can fail due to interturn short-circuit of the exciting coil or breakage of a conducting line, or a nozzle can become obstructed because of a coarse contamination of the lubricant.

SUMMARY OF THE INVENTION

The object of the invention is that of detecting disturbances in the lubrication function caused by a defect of the pump or an oil-line closure on the pressure side of the pump by electrical means in order to avoid harmful consequences resulting. Harmful consequences are understood to be failures in the lubricated machine, for example storage damages, but also production failures, material losses due to defective production, and disturbances in the general operating course.

Starting from an oil lubrication system of the type mentioned at the outset, this task is solved in accordance with the invention by designing a scanning device at the pump which produces a receipt impulse during the working stroke when the pump piston reaches its end position and by the fact that a monitoring device is provided which recognizes the appearance of a receipt impulse within a certain time after each current impulse and which gives a discrepancy signal when a receipt impulse is omitted. When the piston pump stops due to an electrical or mechanical defect, consequently, the monitoring device recognizes this immediately, so that the discrepancy impulse can be utilized under the given circumstances to give an alarm or to switch off the machine endangered by deficient lubrication by its own action.

A further reason for the interruption in the lubrication function can also be due to the fact that the oil storage vessel which feeds the pump involved has run empty. It is therefore proposed for supplementing the monitoring device that the oil storage vessel be provided with a filling-state monitor which releases an oil-deficiency signal when the filling level drops below a certain mark. This electrical oil-deficiency signal and/or a spurious signal of the monitoring device is preferably given to a separate switch-off unit which is provided with a time element and stops the production machine or the machine part particularly involved within a certain time after the appearance of the input signal involved by means of other switching elements, for example relays. The time member can be tuned to the emergency run properties of the machines. It is thereby possible to avoid a perhaps unnecessary stoppage of a complicated production device if, for example, the servicing personnel are warned by an acoustic discrepancy signal and the disturbance can be eliminated rapidly, for example by filling in lubricating oil.

It is suitable to provide indicator lamps to make the response of the control devices mentioned recognizable. A particularly simple and advantage method to achieve this is to provide an indicator lamp which signals on each current impulse and thereby indicates the stroke rate of the piston pump but which lights up permanently after the spurious impulse. One such lamp per piston pump is thus sufficient to immediately recognize disturbance cases which might possibly lead to the destruction of many piston pumps. On the other hand, only one disconnecting unit need normally be provided for a whole group of piston pumps or for each machine.

BRIEF DESCRIPTION OF THE DRAWING

An example of execution of the invention is illustrated below with the aid of the systematic drawing.

DESCRIPTION OF THE PREFERRED EMBODIMENT

An electromagnetically driven piston pump 1 corresponding to older application U.S. Pat. No. 4,349,085 with its pump intake 2 is connected with oil-storage vessel 3 in an unrepresented way. An unrepresented pressure-resistant hose line is connected to its pressure connection 4, which leads to a nozzle located at the lubrication site, which can also be designed as a jet or spray nozzle. The pump piston movable in the direction of arrow 5 is prolonged with its upper end so as to project out of the pump housing or projects in its upper end position, which corresponds to the rest position, from inside into vault 6 of the housing cover. An inductive scanning device 7 is arranged above this vault 7, which releases receipt impulse 8 only if the magnetic armature and therewith the pump piston completely reaches its lower position in the working stroke and thus moves a precisely determined distance from scanning device 7. The scanning device could also contain a contact switch or some other remote position indicator to produce a suitable electric signal.

Exciting coil 9 of piston pump 1 is fed with current impulses 11 of time stage 10. In principle, this time stage is a sawtooth generator fed from pulse generator 12 and which releases a current impulse each time on reaching an adjustable comparison voltage at regulating unit 13. The individual current impulse has a duration of 60 m/sec. The current pulse-recurrence frequency, i.e., the pump frequency, is adjustable in this way at between 50 impulses per minute and 1 impulse every 2 minutes.

However, current impulses 11 are forwarded not only to exciting winding 9 but also to monitoring device 14. On the other hand, receipt impulses 8 also pass to this monitoring device. As a result, this electronic monitoring device causes each current impulse to set up a memory which releases the spurious signal 15 after a certain time if it is not erased by a receipt impulse 8 before the expiration of this time. Each current impulse 11 normally causes a complete stroke of the pump piston and thereby induces a receipt impulse 8. The storage time mentioned is selected so that the receipt impulse arrives at the correct time. Only if the pump piston does not move, for example because the exciting winding is defective or it moves too slowly or remains suspended because of a clogging of the nozzle belonging with it, does the receipt impulse come too late, and a spurious signal 15 results. The monitoring device contains light diode 16 which signals at each piston stroke and remains lit in case of the spurious signal.

The electronic switching arrangement described is located on plug-in card 17. Each of the piston pumps, preferably also designed of plug-in type, has such a plug-in card assigned to it. Alternatively, it is also possible for two or more piston pumps to also be connected to one time stage 10. In this case, their pumping rate would be collectively adjustable. In this case, however, at least one scanning device 7 and one monitoring device 14 would be provided for each individual piston pump.

The discrepancy (spurious) signals 15 of the individual monitoring units reach disconnecting unit 18 and there induce the activation of a time member that stops the lubricated machine after a certain time by means of a stoppage signal 19 over unrepresented relays or the like. This is indicated by means of light diode 20.

Finally, in order to also detect the cause of disturbance "oil deficiency", float switch 21 is arranged in the oil-storage vessel, which releases an oil deficiency signal 22 when the oil quantity drops below a certain level, which qualitatively corresponds to discrepancy signals 15 and is also forwarded to switch-off device 18. If an automatic stoppage of the machine thus takes place, the attendant person can recognize which pump is defective by the flashing of one of light diodes 16. If the pumps work normally, the stoppage must have taken place because of a shortage of oil.

It can be suitable to use an oil lubrication system with many piston pumps and if necessary several oil-storage vessels for various oil types for the lubrication. In this case, a disconnecting unit of its own will be provided for each machine or each individual switch-selected drive. Each of these disconnecting units will receive the discrepancy signals from those pumps which lubricate the machine involved, and also the oil-shortage signals of the oil-storage vessels with the oil types used for this machine. The oil lubrication system described is accordingly extremely adaptable. Additional optical or acoustic indicator elements may be suitable in advanced developmental stages.

It should also be mentioned that, in the event of the automatic stoppage of a machine, disconnecting unit 18 reacts on time stages 10 of the piston pumps involved and also stops the latter. After elimination of the cause of the disturbance, the initial state can be restored by means of an unrepresented release key and further circuitry provisions.

GLOSSARY 1 piston pump
2 pump intake
3 oil-storage vessel
4 pressure connection
5 armature movement
6 vault
7 scanning device
8 receipt impulse
9 exciting winding
10 time stage
11 current impulse
12 pulse generator
13 regulating unit
14 monitoring unit
15 spurious signal
16 light diode
17 plug-in card
18 disconnecting device
19 cut-off signal
20 light diode
21 float switch
22 oil-shortage signal

I claim:

1. An oil lubricating system comprising an electromagnetically driven piston pump having a pump intake and a pump outlet for pumping lubricating oil from an oil storage reservoir to a lubrication site, said pump having a pump piston, an exciting coil responsive to current pulses for moving the pump piston from a first position to a second position to effect the circulation of lubricating oil from the reservoir to the lubrication site, means for producing periodic current pulses, means for applying said periodic current impulses to said exciting coil, each pulse causing the pump piston to move between said first and second positions in response to said current pulses, means coupled to said pump for sensing when the pump piston reaches said second position in response to the application of a current pulse and producing a first control signal indicative of the pump piston reaching said second position, monitoring means responsive to said current pulses and said first control signal for providing a second control signal indicative of improper operation of said piston pump, said monitoring means monitoring the time between receipt of one of said current pulses and the receipt of a corresponding first control signal after the application of said one of said current pulses, and if said first control signal is not received within a predetermined period of time after said one of said current pulses, producing said second control signal indicating that said piston pump is operating improperly.

2. An oil lubricating system comprising an electromagnetically driven piston pump having a pump intake and a pump outlet for pumping lubricating oil from an oil storage reservoir to a lubrication site, said pump having a pump piston, an exciting coil responsive to current pulses for moving the pump piston from a first position to a second position to effect the circulation of lubricating oil from the reservoir to the lubrication site, means for producing periodic current pulses, means for applying said periodic current pulses to said exciting coil, each pulse causing the pump piston to move between said first and second positions in response to said current pulses, means coupled to said pump for sensing when the pump piston reaches said second position in response to the application of a current pulse and producing a first control signal indicative of the pump piston reaching said second position, monitoring means responsive to said current pulses and said first control signal for providing a second control signal indicative of improper operation of said piston pump, said monitoring means monitoring the time between receipt of one of said current pulses and the receipt of a corresponding first control signal after the application of said one of said current pulses, and if said first control signal is not received within a predetermined period of time after said one of said current pulses, producing said second control signal indicating that said piston pump is operating improperly, said oil lubricating system further comprising disconnect means coupled to receive said second control signal and in response thereto producing an output signal for stopping a machine being lubricated by said oil lubricating system.

3. An oil lubricating system comprising an electromagnetically driven piston pump having a pump intake and a pump outlet for pumping oil from an oil storage reservoir to a lubrication site, said pump having a pump piston, an exciting coil responsive to current pulses for moving the pump piston from a first position to a second position to effect the circulation of lubricating oil from the reservoir to the lubrication site, means for producing periodic current pulses, means for applying said periodic current pulses to said exciting coil, each pulse causing the pump piston to move between said first and second positions in response to said current pulses, means coupled to said pump for sensing when the pump piston reaches said second position in response to the application of a current pulse and producing a first control signal indicative of the pump piston reaching said second position, monitoring means responsive to said current pulses and said first control signal for providing a second control signal indicative of improper operation of said piston pump, said monitoring means monitoring the time between receipt of one of said current pulses and the receipt of a corresponding first control signal after the application of said one of said current pulses, and if said first control signal is not received within a predetermined period of time after said one of said current pulses, producing said second control signal indicating that said piston is operating improperly, said oil lubricating system further comprising disconnect means coupled to receive said second control signal and in response thereto producing an output signal for stopping a machine being lubricated by said oil lubricating system, an oil storage reservoir for storing lubricating oil and a filling state monitor to monitor the level of the lubricating oil in said reservoir, said filling state monitor adapted to produce a third control signal coupled to said disconnect means to indicate that the level of the lubricating oil in said reservoir is below a predetermined minimum level, said disconnect means being responsive to said third control signal for producing an output signal for stopping the machine when said oil lubricating level falls below said predetermined minimum level.

* * * * *